US008210713B1

(12) United States Patent
Witt

(10) Patent No.: US 8,210,713 B1
(45) Date of Patent: Jul. 3, 2012

(54) MULTI-COLOR LIGHT EMITTING DIODE HEADSET LIGHT

(76) Inventor: E. Jason Witt, Winchester, KY (US)

( * ) Notice: Subject to any disclaimer, the term of this patent is extended or adjusted under 35 U.S.C. 154(b) by 1827 days.

(21) Appl. No.: 10/806,858

(22) Filed: Mar. 23, 2004

Related U.S. Application Data

(60) Provisional application No. 60/457,015, filed on Mar. 25, 2003.

(51) Int. Cl.
*F21V 9/00* (2006.01)

(52) U.S. Cl. ..... 362/231; 362/240; 362/800; 362/105

(58) Field of Classification Search ..... 362/471, 362/240, 800, 231, 157, 184, 251, 105–106; 315/291
See application file for complete search history.

(56) References Cited

U.S. PATENT DOCUMENTS

| | | | | |
|---|---|---|---|---|
| 4,677,533 | A * | 6/1987 | McDermott et al. | 362/240 |
| 4,947,291 | A * | 8/1990 | McDermott | 362/19 |
| 4,963,798 | A * | 10/1990 | McDermott | 315/312 |
| 5,083,246 | A | 1/1992 | Lambert | |
| 5,161,879 | A * | 11/1992 | McDermott | 362/206 |
| D345,814 | S | 4/1994 | Wright, III | |
| 5,353,205 | A * | 10/1994 | Hudak | 362/105 |
| 5,845,987 | A | 12/1998 | Painter | |
| 5,871,271 | A | 2/1999 | Chien | |
| 5,951,141 | A * | 9/1999 | Bradley | 362/105 |
| 5,997,165 | A | 12/1999 | Lehrer | |
| 6,019,482 | A * | 2/2000 | Everett | 362/184 |
| 6,095,661 | A * | 8/2000 | Lebens et al. | 362/184 |
| 6,179,452 | B1 | 1/2001 | Dunning | |
| 6,232,937 | B1 * | 5/2001 | Jacobsen et al. | 345/87 |
| 6,243,055 | B1 * | 6/2001 | Fergason | 345/32 |
| 6,290,368 | B1 | 9/2001 | Lehrer | |
| 6,422,723 | B1 | 7/2002 | Walters | |
| 6,737,811 | B2 * | 5/2004 | Zhang et al. | 315/56 |
| 6,788,011 | B2 * | 9/2004 | Mueller et al. | 315/294 |
| 6,923,548 | B2 * | 8/2005 | Lim | 362/231 |
| 2002/0027777 | A1 * | 3/2002 | Takasu | 362/105 |
| 2002/0030649 | A1 * | 3/2002 | Zavracky et al. | 345/87 |
| 2005/0040772 | A1 * | 2/2005 | Guzman et al. | 315/291 |

* cited by examiner

*Primary Examiner* — Robert May
(74) *Attorney, Agent, or Firm* — John D. Gugliotta, PE, Esq.

(57) ABSTRACT

An illuminating device which utilizing multiple colored Light Emitting Diodes (LED's) is disclosed. The device incorporates a voltage regulator to allow it to operate on a wide range of voltages typically found on aircraft electrical systems. Additional controls are provided for brightness or dimming controls, and for the selection of the color output. The device includes a mounting clip for attaching it to a boom microphone on an aviation headset, though it could be used in a handheld manner as well.

5 Claims, 4 Drawing Sheets

| 165 POSITION | 170 GREEN SEGMENT | 175 BLUE SEGMENT | 180 RED SEGMENT |
|---|---|---|---|
| 1 | OFF | OFF | OFF |
| 2 | ON | OFF | OFF |
| 3 | OFF | ON | OFF |
| 4 | OFF | OFF | ON |
| 5 | ON | ON | OFF |
| 6 | OFF | ON | ON |
| 7 | ON | OFF | ON |
| 8 | ON | ON | ON |

*Fig. 5*

MULTI-COLOR LIGHT EMITTING DIODE HEADSET LIGHT

RELATED APPLICATIONS

This application claims the benefit of U.S. Provisional Application No. 60/457,015 filed on Mar. 25, 2003.

BACKGROUND OF THE INVENTION

1. Field of the Invention

The present invention relates generally to portable lighting systems, and, more particularly, to a multi-colored light emitting diode headset light.

2. Description of the Related Art

High-intensity Light Emitting Diodes (LED's) are a fairly recent electronic development. Their high light output coupled with low power consumption, make them an ideal replacement for incandescent lamps in certain applications. One such application is that of being used in flashlights. LED flashlights generally produce a very soft diffused light in one color such as white, red or yellow. Additional advantages of such light are the production of little or no heat as well as virtually unlimited life. However, the color of light produced cannot easily be changed, and one color of light, such as red, which may be ideal for night use, quickly becomes unusable when trying to view a map with red markings. Accordingly, there exists a need for a means by which LED illumination arrays can be produced which generate variable light colors as selected by the user.

A search of the prior art did not disclose any patents that read directly on the claims of the instant invention; however, the following references were considered related:

U.S. Pat. No. 5,083,246, issued in the name of Lambert, discloses an illumination apparatus releasably mounted to the microphone mounted to a pilot's helmet, the apparatus for illuminating a portion of the cockpit area of an aircraft;

U.S. Pat. No. 5,353,205, issued in the name of Hudak, discloses a lighting device mounted to the earpiece of a pilot's headset;

U.S. Pat. No. 5,845,987, issued in the name of Painter, discloses a hat having a lamp for illuminating indicia thereon;

U.S. Pat. No. 5,871,271, issued in the name of Chien, discloses protective headwear having at least one LED illumination arrangement fitted into recesses in the protective layer and visible through an partially transparent area;

U.S. Pat. No. 5,951,141, issued in the name of Bradley, discloses a head mounted illumination device;

U.S. Pat. Nos. 5,997,165 and 6,290,368 issued in the name of Lehrer, discloses a portable reading light device;

U.S. Pat. No. 6,179,452, issued in the name of Dunning, discloses a flexible lighting system for an aircraft mounted above the instrument panel;

U.S. Pat. No. 6,422,723, issued in the name of Walters, discloses a portable cockpit illumination device having a housing that is mounted above the instrument panel; and U.S. Pat. No. Des. 345,814, issued in the name of Wright, III, discloses an ornamental design for a headset mounted flashlight holder.

Consequently, there exists a continuous need for new ideas and enhancements for existing products in the xx industry.

SUMMARY OF THE INVENTION

It is therefore an object of the present invention to provide an illumination device mounted to a headset.

It is a feature of the present invention to provide an illumination device having at least one light emitting diode (LED), the LED having either a single color light or of the tri-color variety.

It is another feature of the present invention to provide an illumination device having a plurality of LEDs.

It is another feature of the present invention to provide an illumination device having a color control knob, the color control knob having a knurled surface for rotational control. The color control knob is coupled to a switch for controlling and manipulating the transmission of differently colored light.

It is another feature of the present invention to provide an illumination device having an intensity control knob, the intensity control knob having a knurled surface for rotational control. The intensity control knob is coupled to a potentiometer for manipulating the relative intensity of the generated and transmitted light.

Briefly described according to one embodiment of the present invention, an illumination mounted to a headset comprises an elongated body having a lense assembly, a control assembly and a case housing intermediately therebetween. A color control knob is operatively and mechanically coupled to an eight position DIP switch for controlling the type and number of colors in the light emitting diode that are transmitted. An intensity control knob is operatively and mechanically coupled to a potentiometer for controlling the intensity of the transmitted light. A mounting clip is affixed to the case housing, the clip provided for releasable attachment to a microphone boom or other similar item. A power supply provides electricity to the light emitting diode.

| DESCRIPTIVE KEY | |
|---|---|
| 10 | multi-color light emitting diode headset light |
| 12 | elongated body |
| 15 | cental case housing |
| 20 | head lense assembly |
| 25 | tail control assembly |
| 30 | color control knob |
| 35 | light path |
| 40 | intensity control knob |
| 45 | knurled surface |
| 50 | power cable |
| 55 | strain relief |
| 60 | mounting clip |
| 65 | support mechanism |
| 70 | outer ring |
| 75 | clear flat lense |
| 80 | o-ring |
| 85 | tri-color light emitting diode (LED) |
| 90 | polished reflector |
| 95 | leads |
| 100 | DC power source |
| 105 | ground |
| 110 | voltage regulator |
| 115 | green segment |
| 120 | blue segment |
| 125 | red segment |
| 130 | current limiting resistor |
| 135 | NPN Darlington transistor |
| 140 | eight position rotary DIP switch |
| 145 | potentiometer |
| 150 | voltage dividing network |
| 155 | N channel MOSFET |
| 160 | common pole |

-continued

| DESCRIPTIVE KEY | |
|---|---|
| 165 | first column |
| 170 | second column |
| 175 | third column |
| 180 | fourth column |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 5.

1. Detailed Description of the Figures

Figure 1:
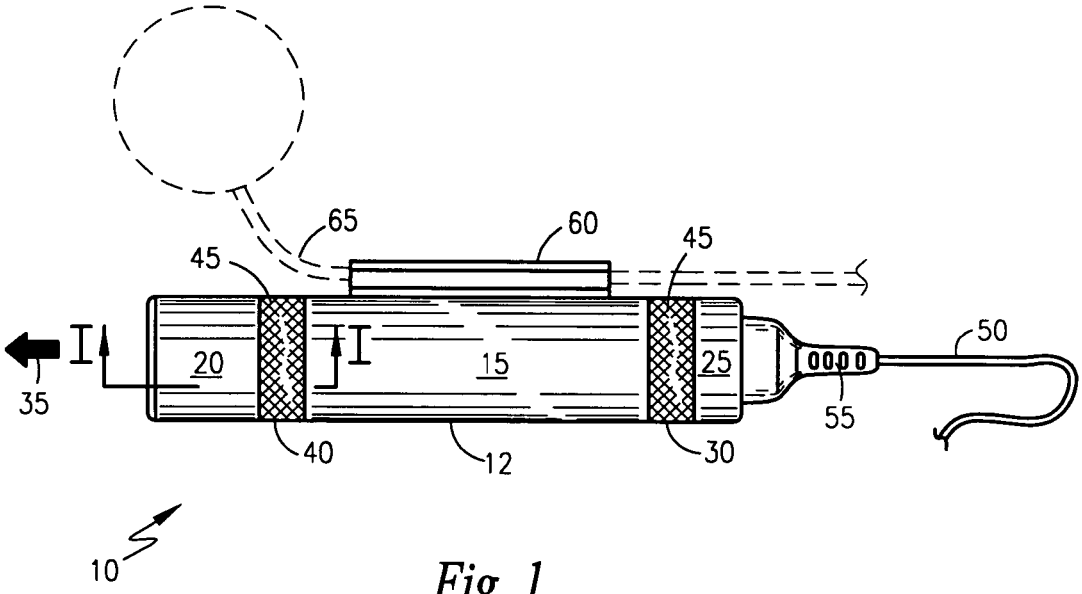
FIG. 1 is a side view of the multi-color light emitting diode headset light 10, according to a preferred embodiment of the present invention.

Referring now to FIG. 1, a side view of the multi-color light emitting diode headset light 10 is depicted, according to a preferred embodiment of the present invention. The multi-color light emitting diode headset light 10 comprises an elongated body 12 having a central case housing 15, a head lense assembly 20 and a tail control assembly 25. The total overall size of the three components is envisioned to be approximately three to four inches long, and approximately ¾ of a inch in diameter. The material of construction of the three components is envisioned to be high-impact plastic, aluminum, or other similar material that is lightweight and impervious to shock or impact. A color control knob 30 is located between the tail control assembly 25 and the central case housing 15 for the purposes of activating the multi-color light emitting diode headset light 10 as well as controlling the color of the light emitted from the multi-color light emitting diode headset light 10 as indicated by a light path 35 as shown. An intensity control knob 40 is located between the central case housing 15 and the head lense assembly 20 for the purposes of controlling the brightness or intensity of the light emitted from the multi-color light emitting diode headset light 10. Both the color control knob 30 and the intensity control knob 40 are provided with a wide knurled surface 45 to allow them to be activated and controlled even with gloved hands. The control is of a rotary nature, such that turning the color control knob 30 or intensity control knob 40 in one direction will enable a function and turning it back will disable it. The functionality of the color control knob 30 and intensity control knob 40 will be described in greater detail herein below.

A power cable 50 is routed from the rear of the tail control assembly 25 through a strain relief 55. The power cable 50 provides electrical power for the multi-color light emitting diode headset light 10, via its connection to a suitable power supply. It is envisioned that the suitable power supply would be the on-board electrical system in an aircraft, although other vehicles such as motor vehicles could also be utilized, and as such, should not be interpreted as a limiting factor of the present invention. It is also envisioned that a suitable battery pack, such as one worn upon a user's belt, or an internal integral battery pack could also be used as well. A mounting clip 60 is located along the side of the central case housing 15 for connection to a support mechanism 65, such as a boom microphone as shown in FIG. 1 via phantom lines. In such a connected manner as shown, the multi-color light emitting diode headset light 10 would point at, and subsequently illuminate any item or area the user is looking at. The mounting clip 60 would be of a nature that it could be interchangeable and adapt or connect to a wide range of devices using spring loaded clips, clamp mechanisms and the like.

Figure 2:
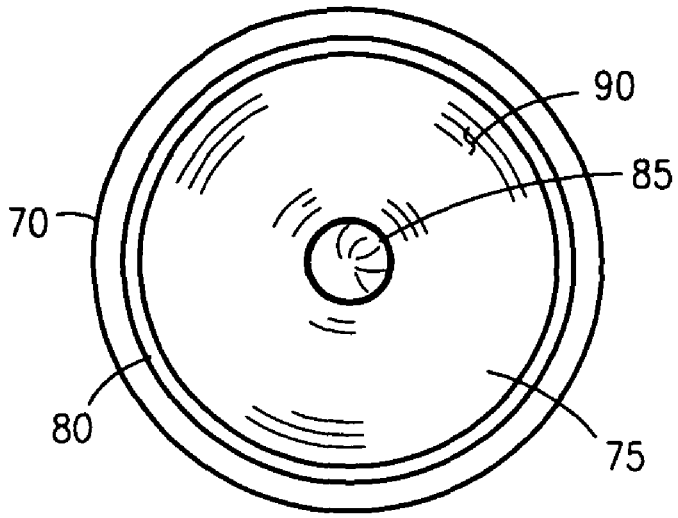
FIG. 2 is an end view of the multi-color light emitting diode headset light 10.

Referring next to FIG. 2, and end view of the multi-color light emitting diode headset light 10 is disclosed. An outer ring 70 retains a clear flat lense 75 behind an o-ring 80 for the purposes of keeping dust, dirt and moisture out of the interior of the multi-color light emitting diode headset light 10. A tri-color light emitting diode (LED) 85 is arranged near the focal point of a polished reflector 90. The tri-color light emitting diode (LED) 85 is envisioned to be of a type similar to LF59EMBGMBC HIGH EFFICIENCY RED/BLUE/GREEN as manufactured by Kingbright Corporation. While it is envisioned that the tri-color light emitting diode (LED) 85 would be capable of producing red, blue and green light, thus comprising all three primary colors, almost any other, including white, could be produced dependent upon the position of the color control knob 30 (as shown in FIG. 1). However, other possible colors or types of light emitting diodes (LED's) such as infrared, white, or the like could be substituted as well to perform added functionality. Additionally, multiple light emitting diodes could be placed inside the polished reflector 90 near the focal point, thus producing an array of independent light emitting diodes. An example of such an array would be a white LED to be used for general illumination, a red LED for use in a cockpit to preserve night vision, and an infrared LED for use with night vision goggles or equipment. It is envisioned that multiple, independent, and different LED's would be suitable for substitution by the final end user, or could require the purchase of separate dedicated multi-color light emitting diode headset light 10 for each type of application.

Figure 3:
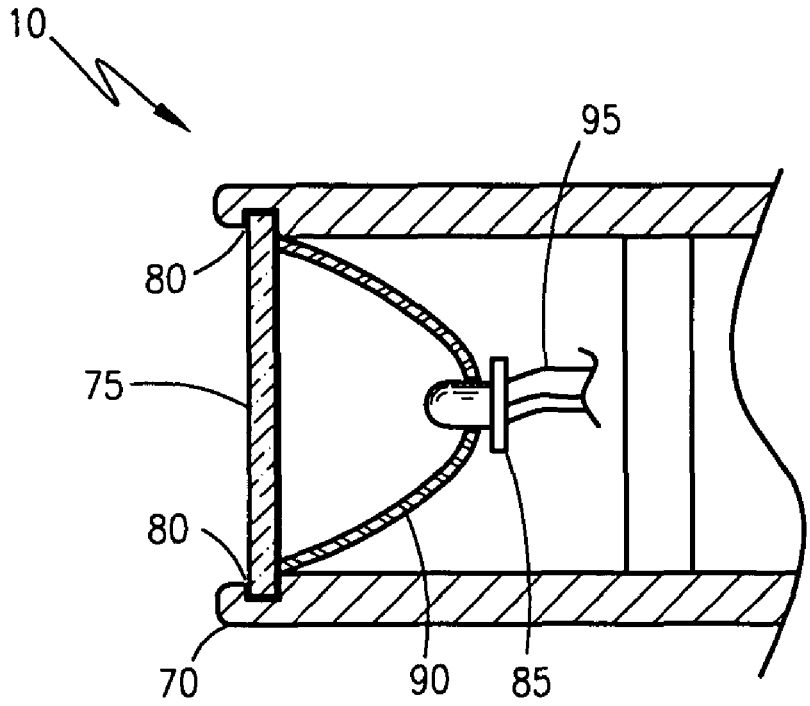
FIG. 3 is a sectional view of the multi-color light emitting diode headset light 10 as seen along a line I-I as shown in FIG. 1.

Referring now to FIG. 3, a sectional view of the multi-color light emitting diode headset light 10, as seen along a line I-I as shown in FIG. 1 is depicted. This FIG. more clearly depicts the interior configuration of the polished reflector 90 with the tri-color light emitting diode (LED) 85 located at the focal point of the said polished reflector 90. A series of leads 95 provide electrical power to the tri-color light emitting diode (LED) 85 and will be described in greater detail herein below.

Figure 4:
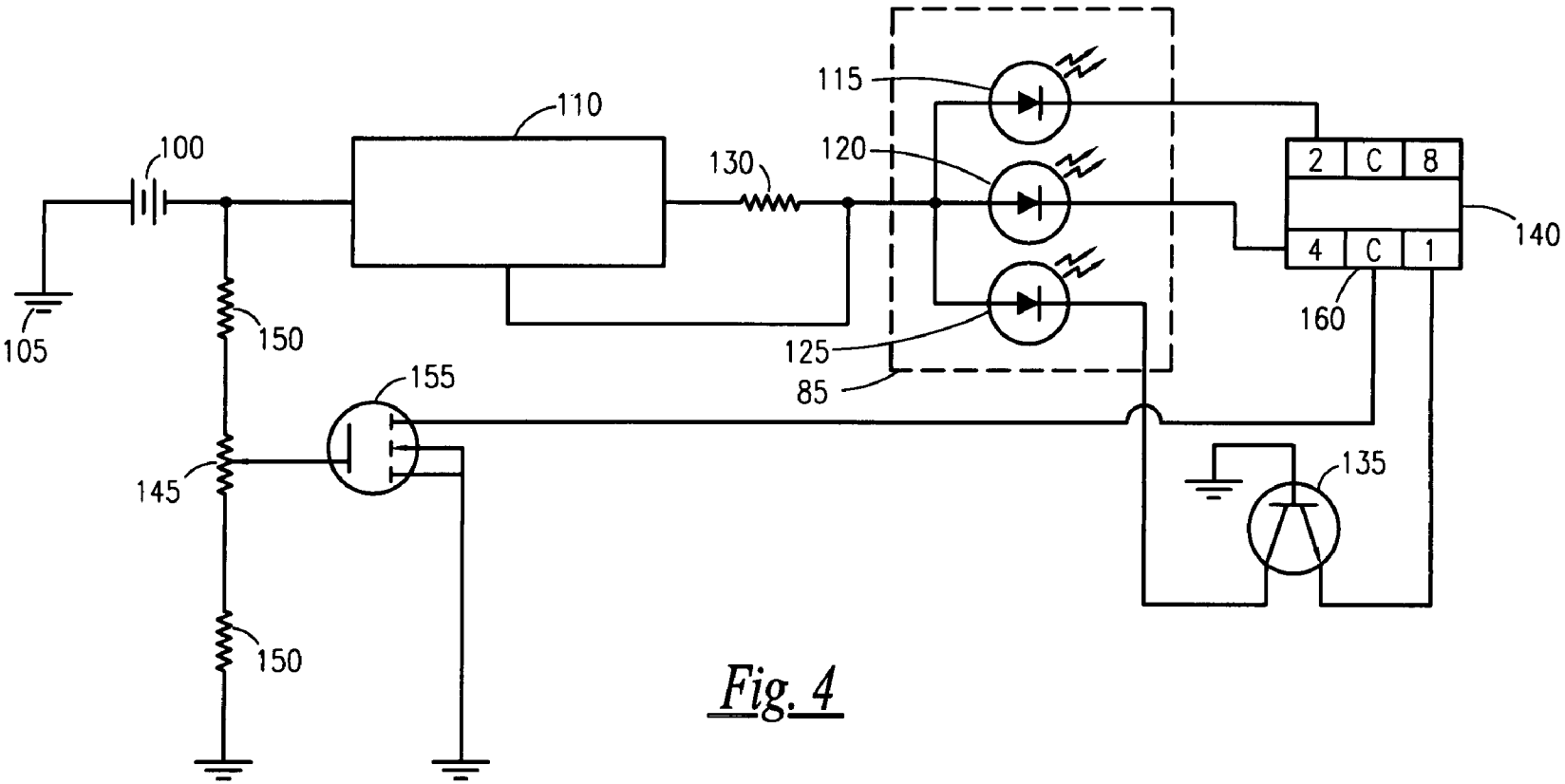
FIG. 4 is an electrical schematic depicting the internal circuitry of the multi-color light emitting diode headset light 10; and, FIG. 5 is a table depicting the operational color characteristics of the multi-color light emitting diode headset light 10.

Referring now to FIG. 4, an electrical schematic of the internal circuitry of the multi-color light emitting diode headset light 10 is disclosed. A DC power source 100 is referenced to ground 105 as indicated. The DC power source 100 can be a battery as indicated, but also part of an electrical system such as found on an aircraft or other type of mobile vehicle. The voltage associated with the DC power source 100 is envisioned to be allowed to vary between 6 volts and 30 volts as shown. The correct voltage with limited current as needed by the multi-color light emitting diode headset light 10 is provided by a voltage regulator 110. The output of the voltage regulator 110 is routed to the anode side of the tri-color light emitting diode (LED) 85 from which all three anodes of a green segment 115, a blue segment 120, and a red segment 125 are connected in a common matter through a current limiting resistor 130. The cathode connection of the respective green segment 115, blue segment 120, and red segment 125 are routed through a NPN Darlington transistor 135 which serves to drive the tri-color light emitting diode (LED) 85 at high gain up to one amp. Electrical control is provided by an eight position rotary DIP switch 140 which is mechanically connected to the color control knob 30 (as shown in FIG. 1) The actual segment of the tri-color light emitting diode (LED) 85 to be illuminated is determined by contact switch closures inside the eight position rotary DIP switch 140. Operation of said eight position rotary DIP switch 140 will be described in greater detail herein below. Position of eight position rotary DIP switch 140 will govern color output from the tri-color light emitting diode (LED) 85. Illumination level is provided by a potentiometer 145 which is part of a voltage dividing network 150. The potentiometer 145 is mechanically connected to the intensity control knob 40 (as shown in FIG. 1) to provide for the illumination intensity afforded by the multi-color light emitting diode headset light 10. It is envisioned that high intensity would be used for distant illumination, or for detailed tasks requiring maximum illumination. Lower intensity would be used for close-in, and/or general illumination. The output of the potentiometer 145 is routed through a N channel MOSFET 155 which is connected to a common pole 160 of the eight position rotary DIP switch 140

Referring finally to FIG. 5, a table depicting the operational characteristics of the multi-color light emitting diode headset light 10 is disclosed. Since the eight position rotary DIP switch 140 (as shown in FIG. 4) is an eight position device, up to eight different operating modes can be provided for the tri-color light emitting diode (LED) 85. A first column 165 indicates the eight possible positions of the eight position rotary DIP switch 140. A second column 170 indicates the illumination status of the green segment 115, a third column 175 indicates the illumination status of the blue segment 120, and a fourth column 180 indicates the illumination status of the red segment 125. In the first position, all elements are off. In the second through fourth position, each segment is illuminated independently, thus producing only green light, blue light and red light respectively. In the fifth position, both the green segment and the blue segment are illuminated. In the sixth position, both the blue segment and the red segment are illuminated. In the seventh position, the green and the red segment are illuminated. Finally, in the eight position, the green segment, the blue segment and the red segment are all equally illuminated, thus producing white light.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. After procurement of the multi-color light emitting diode headset light 10, it would be connected to a suitable electric supply via the power cable 50. Such connection is envisioned to occur using a connector suitable for the environment used, such as a cigarette lighter in the case of a motor vehicle. Next, the multi-color light emitting diode headset light 10 is fastened to a suitable support mechanism 65 using the mounting clip 60. A boom microphone as used as part of a radio headset is an envisioned support mechanism 65 as previously described. The use would not only have application in the commercial aviation arena, but the military as well. At this point, the multi-color light emitting diode headset light 10 is ready for use.

Should illumination be desired, the user would turn the color control knob 30 from its off position to one of the other 7 positions as described in FIG. 5. As an example, should white light be desired, the color control knob 30 would be turned so that all segments of the tri-color light emitting diode (LED) 85 are active. The user may then adjust the illumination intensity or brightness of the multi-color light emitting diode headset light 10 by use of the intensity control knob 40. The multi-color light emitting diode headset light 10 is then used as an illumination source for general or task lighting as needed. When finished, it is deactivated, by turning the color control knob 30 to its off position, where the above mentioned cycle can repeat again.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An illumination device mounted to a headset, said illumination device comprising:

an elongated body having a lens assembly at an end, a control assembly at an opposing end, and a central case housing intermediately therebetween;

a plurality of light emitting diodes, wherein at least one of said light emitting diodes comprises a tri-color diode;

said lens assembly having a polished reflector and at least one light emitting diode at a focal point thereof, said light emitting diode operatively coupled to an electrical supply;

a color control knob having a knurled surface rotatably adjustable for adjusting the color provided by said light emitting diode, wherein said color control knob is mechanically coupled to an eight position rotary DIP switch for controlling the color of light transmitted via said light emitting diode;

an intensity control knob having a knurled surface rotatably adjustable for adjusting the intensity of the color provided by said light emitting diode;

a mounting clip affixed to said central case housing, said clip releasably attached to a microphone boom of said headset; and a power supply transmitting electricity to said light emitting diode.

2. The illumination device of claim 1, wherein one position of said switch is off.

3. The illumination device of claim 1, wherein one position of said switch is on.

4. The illumination device of claim 3, wherein said on position includes light transmission combinations of the three diodes in said light emitting diode.

5. The illumination device of claim 4, wherein light transmission combinations comprises transmission of each of the three diodes of said light emitting diode.

* * * * *